US006019942A

United States Patent [19]

Gromov

[11] Patent Number: 6,019,942

[45] Date of Patent: Feb. 1, 2000

[54] METHOD OF MAINTAINING THE CORROSION RESISTANCE OF A STEEL CIRCULATION SYSTEM WITH A LEAD-CONTAINING COOLANT

[75] Inventor: Boris Fedorovich Gromov, Obninsk, Russian Federation

[73] Assignee: Institute of Physics and Power Engineering, Obninsk, Russian Federation

[21] Appl. No.: 08/973,954

[22] PCT Filed: Aug. 6, 1996

[86] PCT No.: PCT/RU96/00220

§ 371 Date: Nov. 17, 1997

§ 102(e) Date: Nov. 17, 1997

[87] PCT Pub. No.: WO97/35047

PCT Pub. Date: Sep. 25, 1997

[30] Foreign Application Priority Data

Mar. 18, 1996 [RU] Russian Federation ..... 96104859

[51] Int. Cl.[7] ..... C23F 11/08; C23F 11/18

[52] U.S. Cl. ..... 422/7; 422/19; 976/DIG. 201; 106/14.05; 376/306

[58] Field of Search ..... 422/7, 8, 9, 19; 976/DIG. 201; 106/14.05; 376/306

[56] References Cited

U.S. PATENT DOCUMENTS 4,722,823 2/1988 Honda et al. ..... 376/306

5,375,152 12/1994 Lin ..... 376/310

5,769,966 6/1998 Park ..... 148/242

OTHER PUBLICATIONS

Karatushina, et al. "Experimental investigations for substantiation of the concept of a thermonuclear reactor cooled with lead–based liquid metals." Atomic Energy (Oct. 1995) v. 78(4) p. 291–292.

*Primary Examiner*—Elizabeth McKane

*Attorney, Agent, or Firm*—Ilya Zborovsky

[57] ABSTRACT

The method is to develop an anticorrosive cover out of oxides of structural steel components on a circuit internal surface in which in the course of the circuit operation, the oxygen concentration, which is dissolved in the coolant, is maintained not lower than the value, which has been determined from the expression $$IgC=-0.33-2790/T+IgC_S+IgJC_{Pb},$$

where

C is the concentration of oxygen, dissolved in the coolant, mass %;

T is the coolant maximum temperature in the circuit, ° K.;

$C_S$ is the saturated concentration of oxygen dissolved in the coolant at the temperature T, mass %;

J is the thermodynamic activity coefficient of lead in the coolant, inverse mass %; and $C_{Pb}$ is the lead concentration in the coolant, mass %.

10 Claims, No Drawings

METHOD OF MAINTAINING THE CORROSION RESISTANCE OF A STEEL CIRCULATION SYSTEM WITH A LEAD-CONTAINING COOLANT

The invention is related to corrosion resistance maintenance technology of surfaces, adjoining in the course of operation the liquid alloys, containing lead, at the temperatures up to 900° K. The invention can be used in metallurgy, chemical industry, nuclear and traditional power engineering.

The method is known of maintaining corrosion stability of a steel circuit with a coolant containing lead. This method, being described in Equation 1 comprises the formation of anticorrosive cover out of oxides of structural steel components on a structural steel surface.

Disadvantage of this method is the fact, that in the course of a circuit operation, the properties of the protective cover can be deteriorated because of the cover dissolution in the coolant, which under certain conditions results in corrosion of structural steels.

The task was to developed and substantiate the method which would be free from this disadvantage. The task given is solved by ensuring in the coolant the conditions which prevent dissolving an anticorrosive cover on the circuit internal surface. This is achieved by maintenance Inn the coolant of dissolved oxygen concentration which is not less than the value determined by the expression $$IgC=-0.33-2790/T+IgC_S+IgJC_{Pb} \qquad \text{Equation 1}$$

where

C—concentration of oxygen dissolved in the coolant, mass %;

T—maximum temperature of the coolant in the circuit, ° K.;

$C_S$—saturated concentration of oxygen dissolved in the coolant at the temperature T, mass %;

j—thermodynamic activity coefficient of lead in the coolant, inverse mass %;

$C_{Pb}$—lead concentration in the coolant, mass %.

The concentration of oxygen dissolved in the coolant can be maintained by introduction into the loop of oxygen itself, its mixtures with gases and water steam. The introduction of the substances, indicated above, is achieved either by gaseous mixture injection into a coolant volume or by their supply at the coolant interface with a gaseous phase. Moreover, the dissolved oxygen concentration can be increased by means of dissolving the coolant component oxides. These oxides of the coolant components can specially be either placed in the certain circuit section or formed due to their crystallization out of the coolant, or formed due to the coolant oxidation in the circuit.

The maintenance of oxygen concentration at the level, not lower than the limit indicated, hampers the processes of oxide anticorrosive cover dissolution on the structural steel surface which is in contact with the coolant. Thus, the technical result indicated is achieved.

The invention is realized in the following way. The control for the concentration of dissolved oxygen was realized in a circulation circuit out of stainless steel X18H1OT with lead-bismuth eutoctic as a coolant, at maximum temperature 623° K. using a galvanic cell with a hero electrolyte. Under given conditions, the utmostly low oxygen concentration, described by the expression is equal to $2.6\cdot10^{-10}$ mass %. In the course of continuous operation of the circuit for 2000 h., the oxygen concentration was maintained from $6\times10^{-6}$ up to $6\times10^{-7}$ mass %. If dissolved oxygen concentration decreased up to the level $6\times10^{-8}$ mass %, the introduction of oxygen into a coolant was carried out by supply of oxygen-argon mixture, 10% of $O_2$, 90% of Ar, at the coolant interface with a gaseous phase. As a result of coolant oxidation with oxygen, the lead oxides were formed which, after dissolving in the melt, increased the concentration of oxygen dissolved in a coolant up to about $6\cdot10^{-7}$ mass %.

After 2000 h of operation, the coolant was drawn off, and there was carried out inspection of loop internal surfaces. The inspection confirmed the integrity of the anticorrosive cover.

I claim:

1. The maintenance method of corrosion resistance of a steel circulation circuit with lead containing coolant, which includes the development of an anticorrosive cover out of oxides of structural steel components on a circuit internal surface characterized in that in the course of the circuit operation, the concentration of oxygen dissolved in the coolant is maintained not lower than the value determined from the expression:

$$IgC=-0.33-2790/T+IgC_S+IgjC_{PB},$$

where

C is the concentration of oxygen dissolved in the coolant, mass %;

T is the maximum temperature of the coolant in the circuit, ° K.;

$C_S$ is the saturated concentration of oxygen dissolved in the coolant at the temperature T, mass %;

j is the thermodynamic activity coefficient of lead in the coolant, inverse mass %; and $C_{Pb}$ is the lead concentration in the coolant, mass %.

2. The method according to claim 1, which is characterized by the fact that the concentration of oxygen, dissolved in the coolant, is maintained by introduction of water steams in the steel circulation circuit.

3. The method according to claim 1, is characterized by the fact that the concentration of oxygen, dissolved in the coolant, is maintained by means of oxygen introduction into the steel circulation circuit.

4. The method, according to claim 3, is characterized by the fact that oxygen is introduced in the mixture with inert gas into the steel circulation circuit.

5. The method according to claim 1, is characterized by the fact that the introduction is realized by means of injection into the coolant.

6. The method according to claim 1, is characterised by realizing the introduction of gas at the coolant interface with a gaseous phase.

7. The method according to claim 1, is defined by the fact, that the concentration of dissolved oxygen in the coolant, is maintained by dissolving in it the oxides of the coolant components.

8. The method according to claim 7, distinguishes itself by a preliminary introduction of the colant oxide components into the circulation circuit.

9. The method according to claim 7, distinguishes itself by the fact that the coolant component oxides are formed by way of their crystallizing out of the coolant.

10. The method according to claim 7, distinguishes itself by collecting the coolant component oxides on a filter.

* * * * *